US005569137A

United States Patent [19]

Uen

[11] Patent Number: 5,569,137

[45] Date of Patent: Oct. 29, 1996

[54] EXCERCISER

[76] Inventor: Samuel Uen, No. 102, Kuo Chung Road, Ta-Li City, Taichung Hsien, Taiwan

[21] Appl. No.: 583,738

[22] Filed: Jan. 17, 1996

[51] Int. Cl.[6] ..... A63B 21/02

[52] U.S. Cl. ..... 482/126; 482/121; 482/125

[58] Field of Search ..... 482/121, 122, 482/124, 125, 126, 127

[56] References Cited

U.S. PATENT DOCUMENTS

| | | | |
|---|---|---|---|
| 4,489,937 | 12/1984 | Kong | 482/126 |
| 4,789,154 | 12/1988 | Mattox | 482/126 |
| 5,022,648 | 6/1991 | Travis | 482/126 |
| 5,131,650 | 7/1992 | Hall | 482/126 |

*Primary Examiner*—Lynne A. Reichard
*Attorney, Agent, or Firm*—Morton J. Rosenberg; David I. Klein

[57] ABSTRACT

An exerciser including a hollow resilient member and two sleeve members respectively secured at two ends of the resilient member. The resilient member is wrapped by a soft cushion member. Two hollow grips are secured at two ends of the resilient member. The interiors of the grips are communicated with the interior of the resilient member. One end of each grip adjacent to the resilient member is formed with a fitting section for fitting around the sleeve member. An elastic rope is passed through the resilient member and the grips. Two stopper bodies are secured at two ends of the elastic rope for preventing the grips and the resilient member from detaching from the elastic rope. The exerciser can be operated in many ways to achieve various types of exercising effects.

7 Claims, 6 Drawing Sheets

EXCERCISER

BACKGROUND OF THE INVENTION

The present invention relates to an exerciser which can be used by many ways, and more particularly to an exerciser which can be used as a dynamobar.

FIG. 1 shows a conventional dynamobar consisting of a spiral spring 1 and two grips 2 secured at two ends of the spiral spring 1. A user can grip the grips 1 with two hands and flex the spiral spring 1 in order to exercise his/her muscle. Accordingly, such dynamobar can only provide the user with one single type of exercising effect without other training function.

SUMMARY OF THE INVENTION

It is a primary object of the present invention to provide an exerciser including a hollow tube-like resilient member and two grips respectively detachably secured at two ends of the resilient member. An elastic rope is passed through the resilient member and the grips, permitting the exerciser to be operated by many ways so as to achieve various types of exercising effects.

The present invention can be best understood through the following description and accompanying drawing, wherein:

DETAILED DESCRIPTION OF THE PREFERRED EMBODIMENTS

Figure 1:
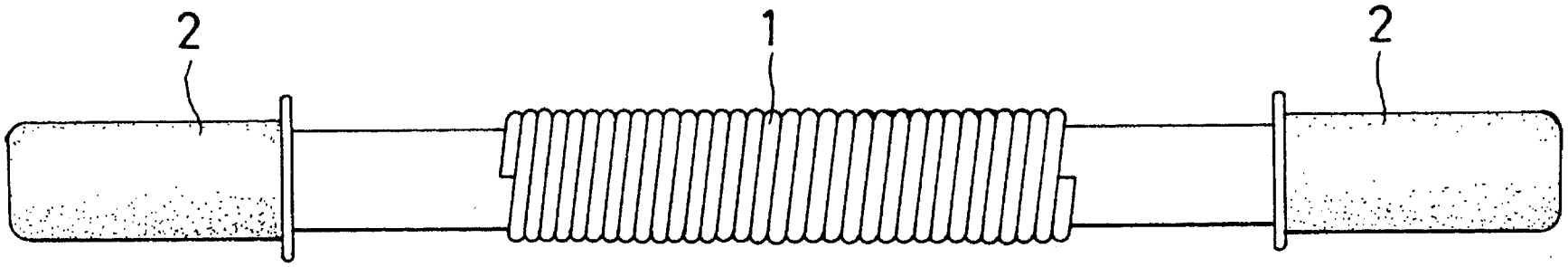
PRIOR ART FIG. 1
FIG. 1 is a plan view of a conventional dynamobar.
Figure 2:
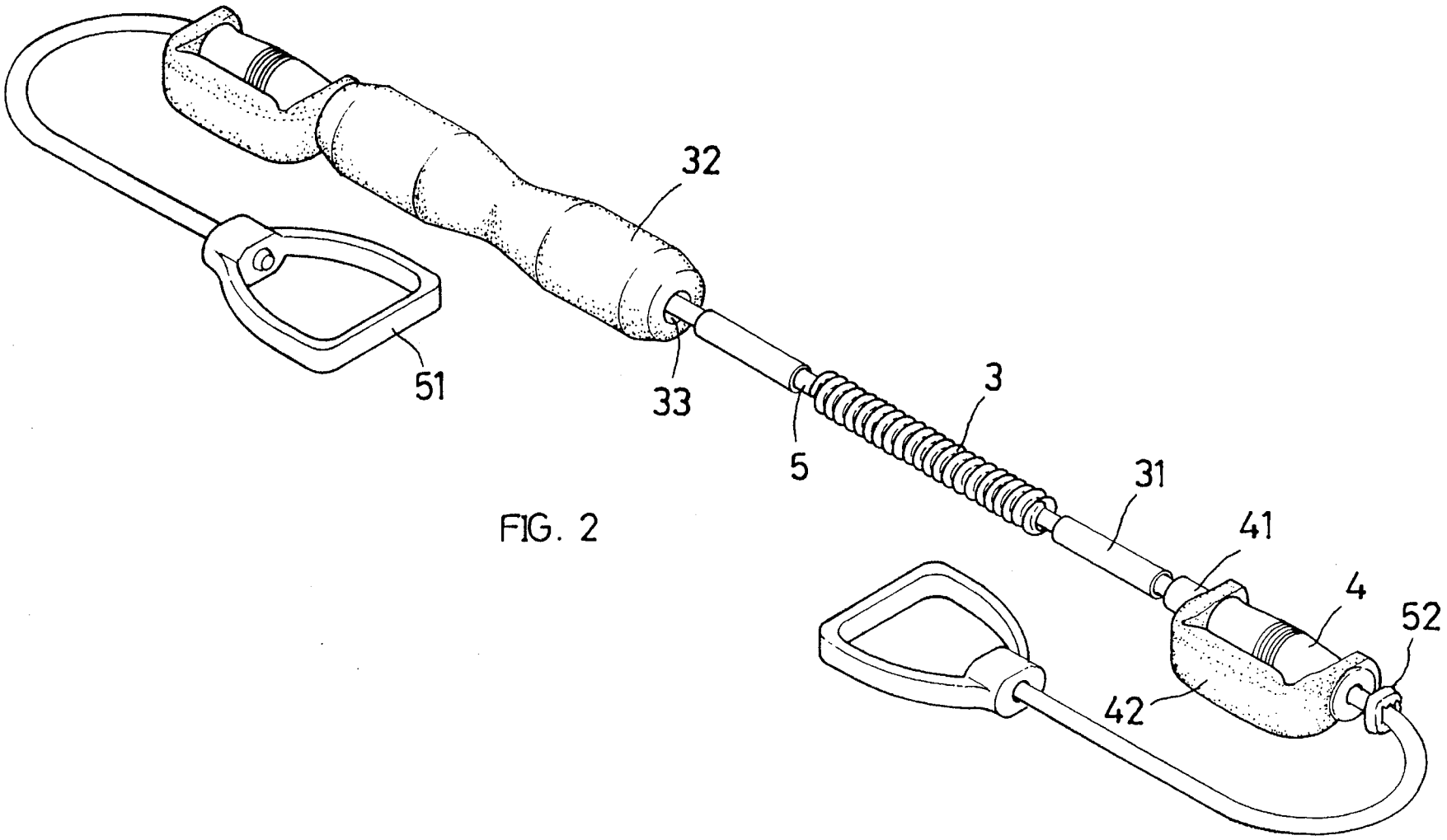
FIG. 2 is a perspective exploded view of the present invention.
Figure 3:
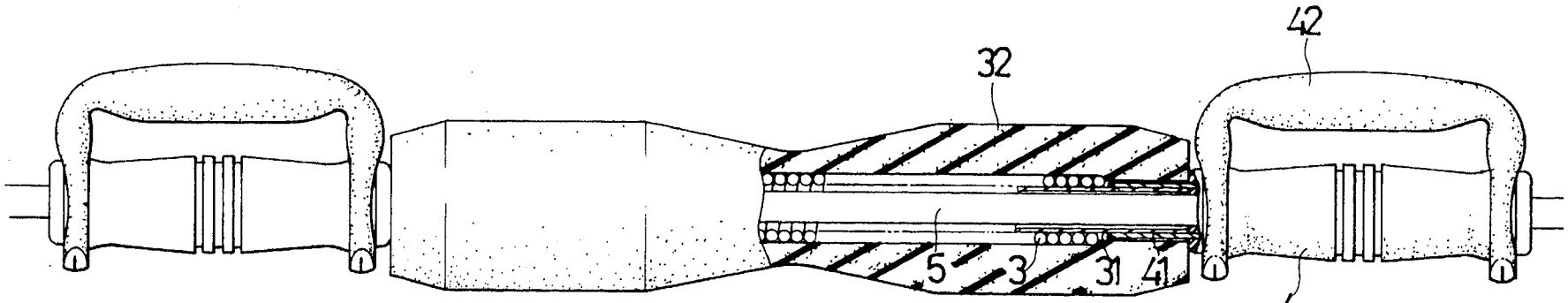
FIG. 3 is a partially sectional assembled plan view of the present invention.
Figure 4:
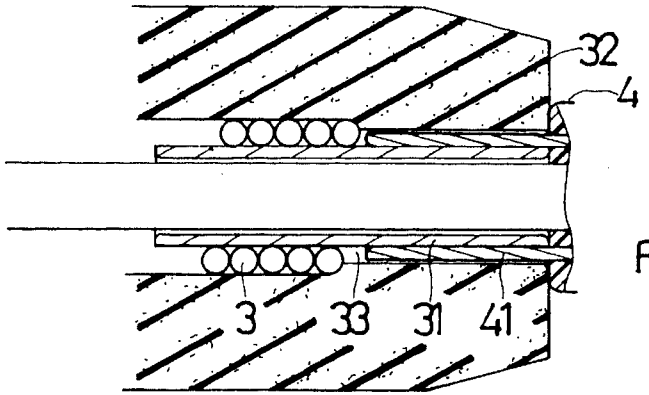
FIG. 4 is an enlarged view of area A of FIG. 3.

Please refer to FIGS. 2 and 3. The exerciser of the present invention includes a resilient member 3, two grips 4 and an elastic rope 5. The resilient member 3 is preferably a hollow tube-like spiral spring with predetermined length. Two sleeve members 31 are respectively secured at two ends of the spiral spring 3 and axially inserted thereinto by a predetermined length with another predetermined length protruding out of the ends of the spiral spring 4. The resilient member 3 and the sleeve members 31 are wrapped by a soft cushion member 32 made of foamed rubber. The inner face of the soft cushion member 32 and the outer face of the sleeve member 31 together define a clearance 33.

The grip 4 is a hollow tube member the interior of which is communicated with the interior of the resilient member 3. One end of the grip 4 adjacent to the resilient member 3 is formed with a fitting section 41 for fitting into the clearance

33 around the sleeve member 31. In addition, the grip 4 is equipped with a U-shaped protective member 42.

The elastic rope 5 is passed through the interior of the resilient member 3 and the grips 4. In an unextended state, the length of the elastic rope 5 is longer than the total length of the resilient member 3 and the grips 4. Two stopper bodies 51 are secured at two ends of the elastic rope 5 for preventing the grips 4 and the resilient member 3 from detaching from the elastic rope 5. In this embodiment, the stopper body 51 is a shackle. In addition, two conventional clip members 52 are fastened on the elastic rope 5 at predetermined positions.

The free ends of the sleeve members 31 and the free ends of the fitting sections 41 of the grips 4 have arch end faces.

Figure 5:
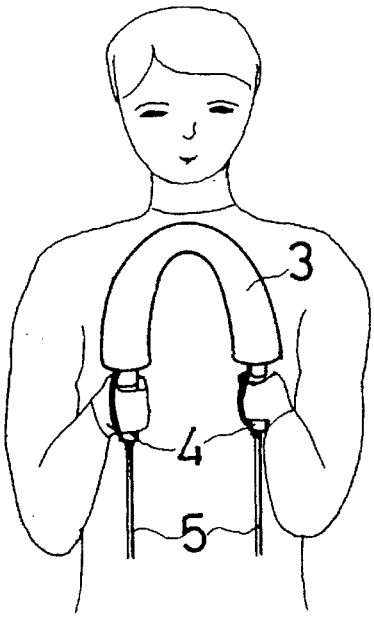
FIG. 5 shows a first type of operation of the present invention.

According to the above arrangement, the fitting sections 41 of the grips 4 are fitted around the sleeve members 31 of the resilient member 3. A user can grip the grips 41 with two hands and force the grips 4 toward each other so as to flex the resilient member 3 as shown in FIG. 5. Because the grips 4 are forced toward each other, the fitting sections 41 will not detach from the sleeve members 31. However, in order to avoid accident caused by improper operation, the clip members 52 can be fastened on the elastic rope 5 adjacent to outer ends of the grips 4 so as to stop the grips 4 from moving.

Figure 6:
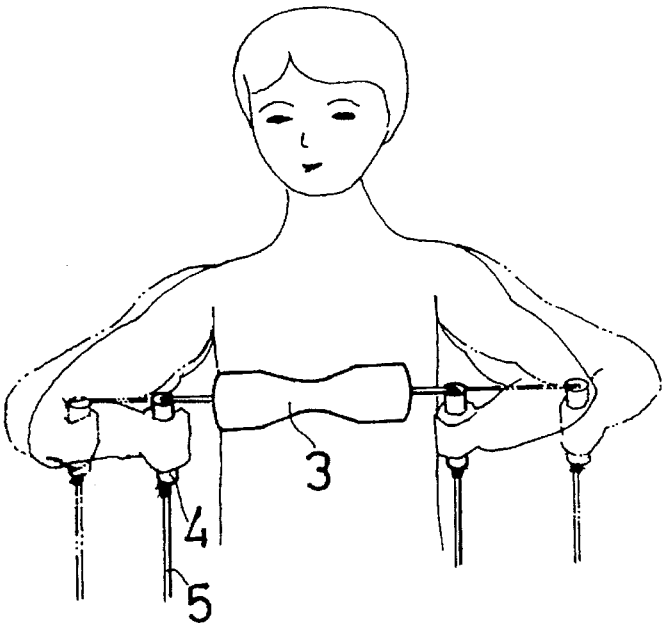
FIG. 6 shows a second type of operation of the present invention.

Referring to FIG. 6, alternatively, the grips 4 can be axially outward pulled along the elastic rope 5 to be separate from the resilient member 3 and stopped by the clip members 52. Accordingly, the user can grip the grips 4 with two hands and horizontally stretch/unstretch the elastic rope 5 in front of the chest for chest expansion exercise.

Figure 7:
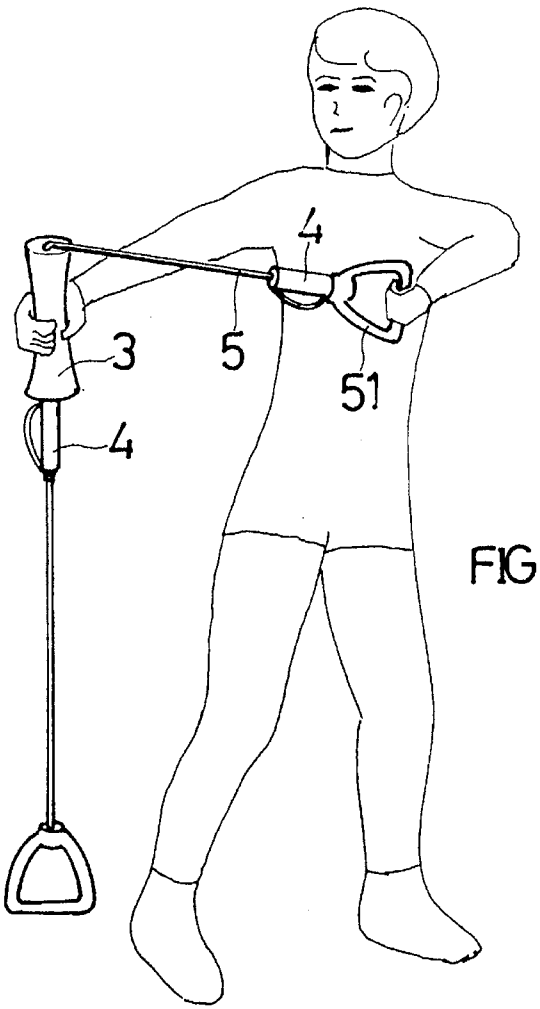
FIG. 7 shows a third type of operation of the present invention.

Referring to FIG. 7, alternatively, the user can grip the soft cushion 32 of the resilient member 3 with one hand and hold the shackle 51 at one end of the elastic rope 5 with the other hand for bowing exercise.

Figure 8:
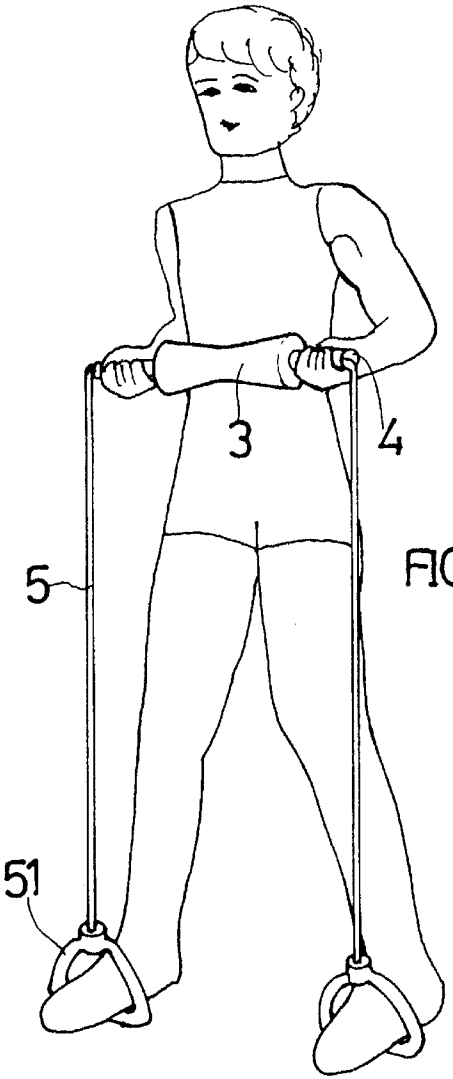
FIG. 8 shows a fourth type of operation of the present invention.

Referring to FIG. 8, still alternatively, the user can step on the shackles 51 with two feet and hold the grips 4 or the resilient member 3 to pull the same upward.

Figure 9:
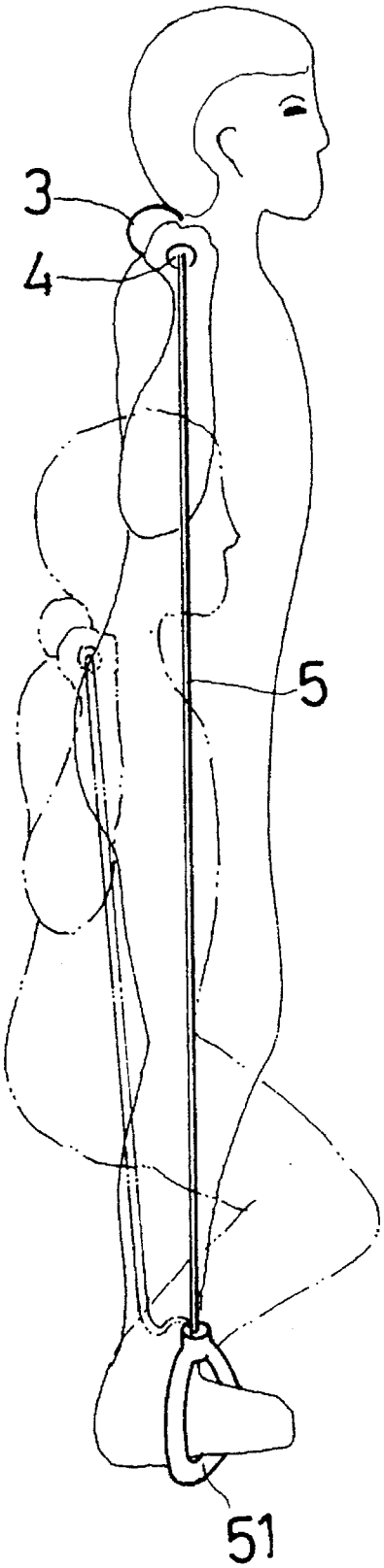
FIG. 9 shows a fifth type of operation of the present invention.

Referring to FIG. 9, the user can step on the shackles 51 and push the resilient member 3 upward with the rear neck portion.

In conclusion, the present invention can be perated in many manners to achieve various types of exercising effects. In another embodiment of the present invention, the sleeve members of the resilient member and the fitting sections of the grips can be formed with threads for engaging the resilient member with the grips by way of screwing.

It is to be understood that the above-description and drawings are only used for illustrating some embodiments of the present invention, not intended to limit the scope thereof. Any variation and derivation from the above description and drawings should be included in the scope of the present invention.

What is claimed is:

1. An exerciser comprising:

a flexible hollow resilient member with a predetermined length, two sleeve members being respectively secured at two ends of the resilient member, the resilient member being wrapped by a soft cushion member;

two hollow grips secured at two ends of the resilient member, the interiors of the grips being communicated with the interior of the resilient member, one end of each grip adjacent to the resilient member being formed with a fitting section for fitting around the sleeve member; and an elastic rope passed through the resilient member and the grips, in an unextended state, the length of the elastic rope being longer than the total length of the resilient member and the grips, two stopper bodies being secured at two ends of the elastic rope for preventing the grips and the resilient member from detaching from the elastic rope.

2. An exerciser as claimed in claim 1, wherein the resilient member is a spiral spring and the soft cushion member is made of foam rubber, the sleeve members being axially inserted into two ends of the spiral spring by a predetermined length with another predetermined length protruding out of the ends of the spiral spring.

3. An exerciser as claimed in claim 1, wherein an inner face of the soft cushion member and an outer face of the sleeve member together define a clearance for the fitting section of the grip to fit thereinto.

4. An exerciser as claimed in claim 1, wherein the free ends of the sleeve members and the free ends of the fitting sections of the grips have arch end faces.

5. An exerciser as claimed in claim 1, wherein the stopper bodies are shackles.

6. An exerciser as claimed in claim 1, wherein the grip is equipped with a "U"-shaped protective member.

7. An exerciser as claimed in claim 1, wherein two clip members are fastened on the elastic rope at predetermined positions.

* * * * *